US008035584B2

(12) United States Patent
Jung

(10) Patent No.: US 8,035,584 B2
(45) Date of Patent: Oct. 11, 2011

(54) ORGANIC LIGHT EMITTING DISPLAY AND IMAGE COMPENSATION METHOD

(75) Inventor: Jin-Woung Jung, Yongin-si (KR)

(73) Assignee: Samsung Mobile Display Co., Ltd., Giheung-Gu, Yongin, Gyunggi-Do (KR)

( * ) Notice: Subject to any disclaimer, the term of this patent is extended or adjusted under 35 U.S.C. 154(b) by 909 days.

(21) Appl. No.: 11/790,049

(22) Filed: Apr. 23, 2007

(65) Prior Publication Data

US 2008/0170004 A1 Jul. 17, 2008

(30) Foreign Application Priority Data

Jan. 15, 2007 (KR) ..... 10-2007-0004434

(51) Int. Cl.
*G09G 3/30* (2006.01)

(52) U.S. Cl. ..... 345/76; 345/77; 345/78; 345/79; 345/80; 345/81; 345/82; 345/83; 315/169.3; 315/204

(58) Field of Classification Search ..... 345/76–83; 315/169.3
See application file for complete search history.

(56) References Cited

U.S. PATENT DOCUMENTS

2006/0071888 A1* 4/2006 Lee et al. ..... 345/82
2007/0103411 A1* 5/2007 Cok et al. ..... 345/82
2008/0100542 A1* 5/2008 Miller et al. ..... 345/77

FOREIGN PATENT DOCUMENTS

KR 2006-0010911 2/2006
KR 10-2006-0053529 5/2006

* cited by examiner

*Primary Examiner* — Richard Hjerpe
*Assistant Examiner* — Jeffrey Steinberg
(74) *Attorney, Agent, or Firm* — Robert E. Bushnell, Esq.

(57) ABSTRACT

An organic light emitting display and an image compensation method improves the Long Range Uniformity (LRU) of the output image by displaying the identical image when the identical image is input to each pixel, by measuring the luminance, chromaticity coordinates and color temperature after an organic light emitting display panel is fabricated, by storing the compensation values thereof in a memory in the form of a look-up table in advance, and by compensating one of a power supply voltage, a data voltage and a light emission time. The organic light emitting display device and an image compensation method includes: a video signal processor; a control unit coupled to the video signal processor to compensate the luminance, chromaticity coordinates and color temperature in order to have the identical output image in relation to the identical input image; and an organic light emitting display panel coupled to the control unit to display the compensation image in which the luminance, chromaticity coordinates and color temperature have been compensated.

19 Claims, 10 Drawing Sheets

ORGANIC LIGHT EMITTING DISPLAY AND IMAGE COMPENSATION METHOD

CLAIM OF PRIORITY

This application makes reference to, incorporates the same herein, and claims all benefits accruing under 35 U.S.C. §119 from an application for ORGANIC LIGHT EMITTING DISPLAY AND IMAGE COMPENSATION METHOD earlier filed in the Korean Intellectual Property Office on 15 Jan. 2007 and there duly assigned Serial No. 10-2007-0004434.

BACKGROUND OF THE INVENTION

1. Field of the Invention

The present invention relates to an organic light emitting display and image compensation method, and more particularly, the present invention relates to an organic light emitting display and image compensation method for improving the Long Range Uniformity (LRU) of the output image by displaying the identical image when the identical image is input to each pixel, by measuring luminance, chromaticity coordinates and color temperature after an organic light emitting display panel is fabricated, by storing the compensation values thereof in a memory in the form of a look-up table in advance, and by compensating one of a power supply voltage, a data voltage and a light emission time using the compensation values.

2. Description of the Related Art

In general, the video characteristics of the organic light emitting display, (for example, luminance, chromaticity coordinate and color temperature), include electrical characteristics, thin film transistor characteristics and organic light emitting diode characteristics.

An organic light emitting diode may be composed of an anode, an organic layer and a cathode. The organic layer may be composed of an emitting layer (EML) that emits light by forming an exciton when an electron and a hole contact each other, an electron transport layer (ETL) for transporting the electron, and a hole transport layer (HTL) for transporting the hole. An electron injecting layer (EIL) may be formed on one side of the electron transport layer, and a hole injecting layer (HIL) may further be formed on one side of the hole transport layer. Furthermore, in a phosphorescent organic light emitting diode, a hole blocking layer may be selectively formed between the emitting layer and the electron transport layer, and an electron blocking layer may be selectively formed between the emitting layer and the hole transport layer.

The resistance of an anode and a cathode of the organic light emitting diode, a voltage drop (IR drop) in the power line (ELVDD, ELVSS) and a degree of uniformity when the organic light emitting diode is deposited on an organic thin film layer, etc. are known factors in the degrading of a Long Range Uniformity (LRU) of the video characteristics.

To reduce this problem, many others have tried to improve the material of the anode and cathode of the organic light emitting diode, to increase the mobility of electrons and holes by laminating organic thin film layers, and to reduce the resistance of the power line by adjusting its width, depth, etc.

However, in spite of these efforts, the LRU of the video is still main issue in the product development and it is not fully improved. That is, there is a deviation of luminance, chromaticity coordinate and color temperature at each pixel even if the material and process are improved as described above, and thus the LRU as well as the short range uniformity are degraded.

In other words, there is a problem that the reliability of the display is reduced and the life time of the display is shortened, since a different image is displayed even when the identical image is input to each pixel with time.

SUMMARY OF THE INVENTION

The present invention obviates the problems discussed above, and an aspect of the present invention is to provide an organic light emitting display and image compensation method to improve the Long Range Uniformity (LRU) of the display image by displaying the identical image when the identical image is input to each pixel, by measuring luminance, chromaticity coordinate and color temperature after an organic light emitting display panel is fabricated, by storing the compensation value thereof in a memory in the form of a look-up table in advance, and by compensating any one of a power supply voltage, a data voltage and light emission time using the compensation value.

To achieve the above-mentioned aspects, the organic light emitting display according to the present invention includes a video signal processor; a control unit coupled to the video signal processor to compensate luminance, chromaticity coordinates and color temperature in order to have the identical output image in relation to the identical input image; an organic light emitting display panel coupled to the control unit to display the compensation image in which luminance, chromaticity coordinates and color temperature have been compensated; a power supplier coupled to the organic light emitting display panel; a scanning driver coupled to the organic light emitting display panel; a data driver coupled to the organic light emitting display panel; and an emission control driver coupled to the organic light emitting display panel.

The control unit may include a memory to store the compensated luminance, chromaticity coordinates and color temperature values of the organic light emitting display panel at each pixel in advance; a first calculating unit to calculate a first compensation value using the compensation value of the respective video signal at each pixel provided from the video signal processor; a second calculating unit to calculate a second compensation value using the first compensation value and a calibrating constant.

The calibrating constant used in the second calculating unit may correspond to one of a power supply voltage, a data voltage and a light emitting time supplied to the organic light emitting display panel.

The compensated luminance value, chromaticity coordinates value and color temperature value at each pixel stored in the memory may be stored as a look-up table.

The second calculating unit may provide the second compensation value to the power supplier.

The power supplier may provide the organic light emitting display panel with the compensated power supply voltage according to the second compensation value.

The second calculating unit may provide the second compensation value to the data driver.

The data driver may provide the organic light emitting display panel with the compensated data voltage according to the second compensation value.

The second calculating unit may provide the second compensation value to the light emitting driver.

The light emitting driver may provide the organic light emitting display panel with the compensated light emitting time according to the second compensation value.

A clock signal supplier is coupled to the video signal processor, and the video signal processor may output a synchronizing signal in the clock signal supplier.

The clock signal supplier may output the synchronizing signal and the clock signal to the scanning driver, the data driver and the light emitting driver.

To achieve the above-mentioned aspects, an image compensation method of an organic light emitting display includes: loading the video signal; loading the compensated luminance value, chromaticity coordinates value and color temperature value at each pixel; calculating the first compensation value using the respective compensation value at each pixel corresponding to the video signal; calculating a second compensation value using the first compensation value and a calibrating constant; and providing the second compensation value to the organic light emitting display panel.

The calibrating constant may correspond to one of a power supply voltage, a data voltage and a light emitting time supplied to the organic light emitting display panel.

The second compensation value may be supplied to one of a power supplier, a data driver and a light emitting driver of the organic light emitting display panel.

The calibrating constant is a value corresponding to a power supply voltage of the organic light emitting display panel, and the second compensation value may be supplied to a power supplier of the organic light emitting display panel.

The calibrating constant is a value corresponding to the a voltage of the organic light emitting display panel, and the second compensation value may be provided to a data driver of the organic light emitting display panel.

The calibrating constant is a value corresponding to a light emitting time of the organic light emitting display panel, and the second compensation value may be supplied to a light emitting driver of the organic light emitting display panel.

As described above, the organic light emitting display and image compensation method according to the present invention measures luminance, chromaticity coordinates and color temperature after an organic light emitting display panel is fabricated, and stores the compensation values in the memory in the form of a look-up table in advance so as to display the identical image when the identical image is input to each pixel.

In addition to, the organic light emitting display and image compensation method according to the present invention improves the Long Range Uniformity (LRU) as well as the Short Range Uniformity (SRU) by compensating the power supply voltage, the data voltage and the light emitting time using the compensation values which have been previously stored in the memory.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
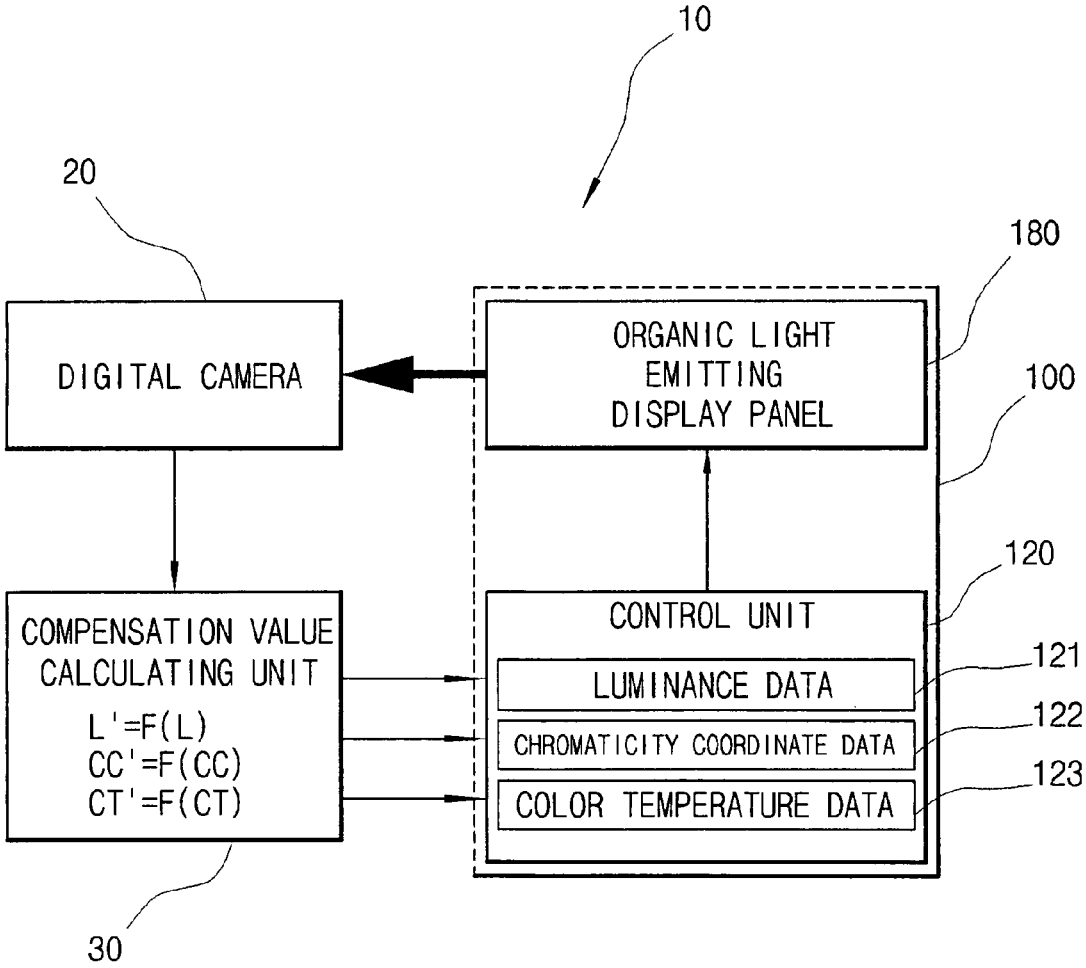
FIG. 1 is a block diagram of an image measuring system for measuring the video characteristics (luminance, chromaticity coordinate and color temperature) of the organic light emitting display before discharge.

FIG. 1 is a block diagram of an image measuring system for measuring the video characteristics (luminance, chromaticity coordinate and color temperature) of an organic light emitting display before discharge.

As illustrated in FIG. 1, the image measuring system 10 includes an organic light emitting display 100, a high quality digital camera 20 for measuring the video characteristics (luminance, chromaticity coordinate and color temperature) of the organic light emitting display 100, and a compensation value calculating unit 30 for calculating the compensation value in order to obtain the identical image output by using the value measured in the high quality digital camera 20.

The organic light emitting display 100 includes memories 121, 122, and 123 in which the initial value of the luminance data, chromaticity coordinate data and color temperature data are stored, a control unit 120 for executing a specific control movement by loading the data from the memories 121, 122, and 123, and an organic light emitting display panel 180 for displaying a specific image under the control of the control unit 120. The structure and operation of the organic light emitting display 100 is described later in greater detail.

The high quality digital camera 20 takes a picture of luminance, chromaticity coordinate and color temperature of every pixel in the organic light emitting display panel 180 and transmits the data thereof to the compensation value calculating unit. It is preferable that the high quality digital camera 20 has a resolving power capable of detecting luminance, chromaticity coordinate and color temperature at each pixel. For example, a ProMetric® high quality digital camera 20, (See www.radiantimaging.com) can measure luminance, chromaticity coordinate value and color temperature at each pixel.

The compensation value calculating unit 30 calculates the compensated luminance value, chromaticity coordinate value and color temperature value at each pixel using the luminance, chromaticity coordinate value and color temperature at each pixel from the high quality digital camera 20 as a basis. The compensation value calculating unit 30 transmits and stores the compensated luminance value, chromaticity coordinate value and color temperature value at each pixel in the memories 121, 122, and 123 after the calculation has been completed.

For example, the compensation value calculating unit 30 calculates the compensated luminance value, chromaticity coordinate value and color temperature value at each pixel using the following formulas.

luminance compensation value $L'=F(L)$ chromaticity coordinate compensation value $CC'=F(CC)$ color temperature compensation value $CT'=F(CT)$ F(L) is a function value with reference to current-voltage-luminance outputting the identical luminance in relation to the identical luminance input, F(CC) is a function value with reference to current-voltage-chromaticity coordinate outputting the identical chromaticity coordinate in relation to the identical chromaticity coordinate input, and F(CT) is a function value with reference to current-voltage-color temperature outputting the identical color temperature in relation to the identical color temperature input.

For example, if the measured luminance is 14000 cd/m$^2$ and the theoretical or experimental luminance is 15000 cd/m$^2$, then the compensation value calculating unit 30 calculates the compensation value (L') so that additional luminance of 1000 cd/m$^2$ is to be output. That is, the compensation value (L') may be the function which divides the theoretical or experimental luminance by the measured luminance. The power supply voltage, the data voltage and the light emitting time to be supplied to the organic light emitting display panel 180 are adjusted to a certain extent corresponding to the compensation value (L'), and are mentioned later.

Furthermore, if the measured chromaticity coordinate value is X=0.283, Y=0.298 and the theoretical or experimental chromaticity coordinate value is X=0.284, Y=0.297, the compensation value calculating unit 30 calculates the compensation value (CC') so that the chromaticity coordinate value of X=+0.001, Y=−0.001 is added thereto. The power supply voltage, the data voltage and the light emitting time to be supplied to the organic light emitting display panel 180 are adjusted to a certain extent corresponding to the compensation value (CC'), and are mentioned later.

Finally, if the measured color temperature is 6400K and the theoretical or experimental color temperature is 6500K, the compensation value calculating unit 30 calculates the compensation value (CT') so that an additional color temperature of 100K is added thereto. The power supply voltage, the data voltage and the light emitting time to be supplied to the organic light emitting display panel 180 are adjusted to a certain extent corresponding to the compensation value (CT'), and are discussed later.

In other words, the present invention adjusts the power supply voltage, the data voltage and the light emitting time so as to have the theoretical or experimental luminance, chromaticity coordinate value and color temperature using the above-mentioned compensation values (L',CC',CT').

Figure 2A:
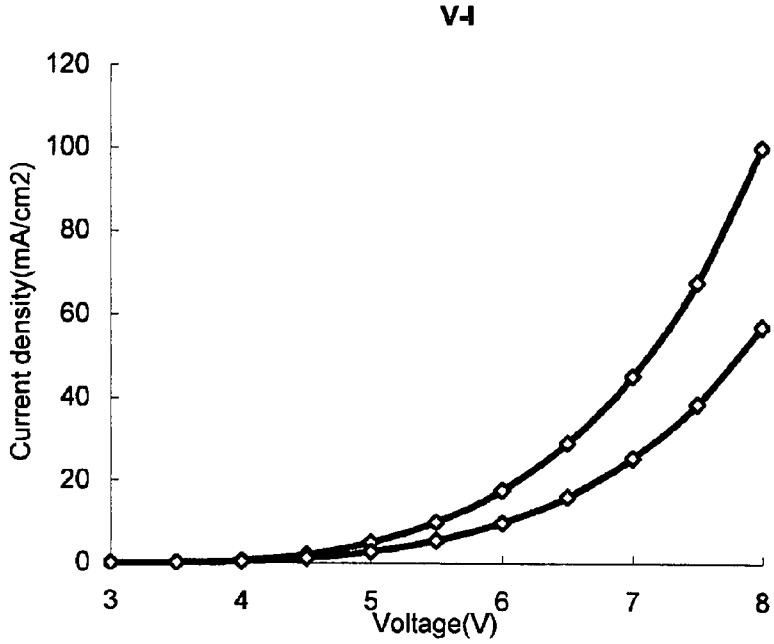
FIGS. 2*a* to 2*c* are graphs of relationships between voltage-current, current-luminance and voltage-luminance of a pixel of an organic light emitting display.
Figure 2B:
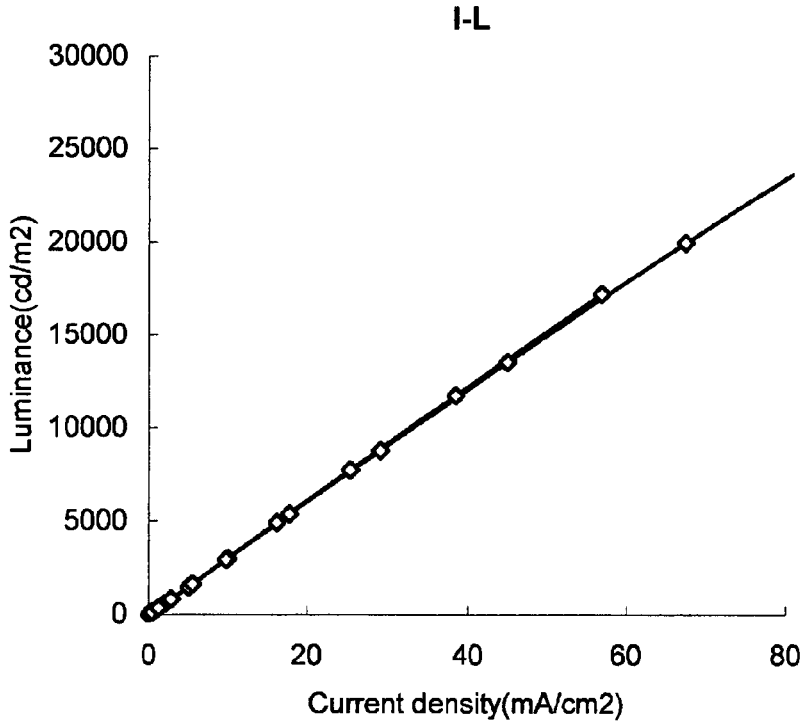
Figure 2C:
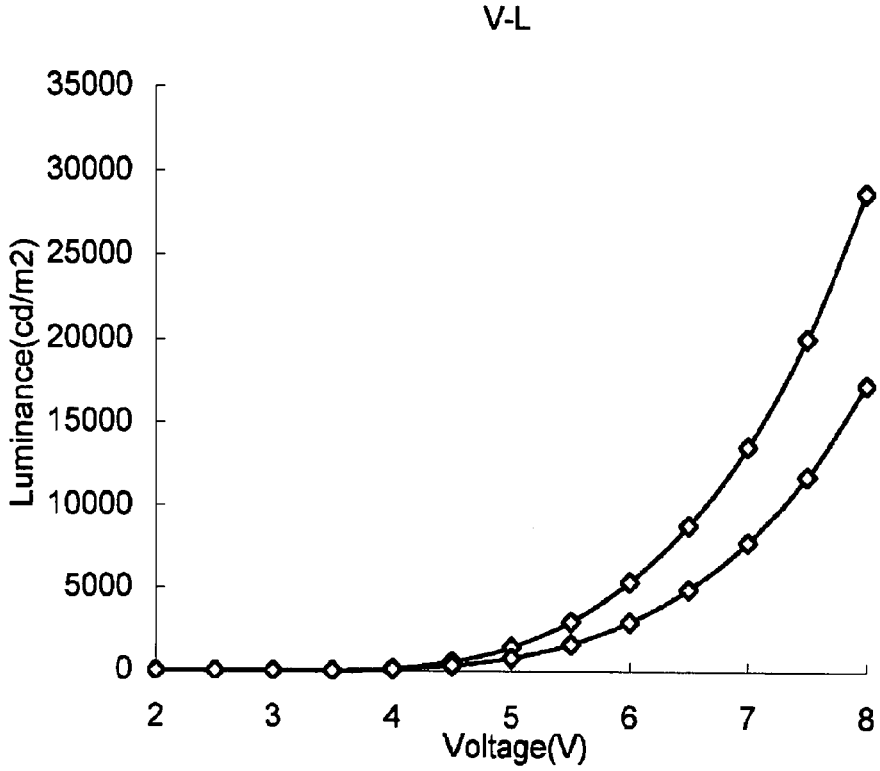

FIGS. 2*a* to 2*c* are graphs of relationships between voltage-current, current-luminance and voltage-luminance of the pixel in an organic light emitting display.

First of all, referring to the voltage-current characteristic curve of FIG. 2*a*, the current density increases exponentially as the voltage supplied to the pixel is increased. Different current densities may be output even if the identical voltage is supplied to each pixel, due to the electrical characteristics, TFT characteristics and organic light emitting diode characteristics, and thus, the identical image output in relation to the identical image input is achieved only when the luminance, chromaticity coordinates and color temperature at each pixel are compensated.

Referring to the current-luminance characteristic curve of FIG. 2*b*, the luminance from the pixel is increased as approximately a 1st order function, as the current supplied to the pixel is increased. Different luminance may be displayed even if the identical current is supplied to each pixel, due to the electrical characteristics, TFT characteristics and organic light emitting diode characteristics, and thus, the identical image output in relation to the identical image input is achieved only when the luminance, chromaticity coordinates and color temperature at each pixel are compensated.

Furthermore, referring to the voltage-luminance characteristic curve of FIG. 2*c*, the luminance from the pixel increases approximately exponentially as the voltage supplied to the pixel is increased.

However, different luminance may be output even if the identical voltage is supplied to each pixel, due to the electrical characteristics, TFT characteristics and organic light emitting diode characteristics, and thus, the identical image output in relation to the identical image input is achieved only when the luminance, chromaticity coordinates and color temperature at each pixel are compensated.

In conclusion, as illustrated in FIGS. 2*a* to 2*c*, there is a deviation of luminance (including chromaticity coordinates and color temperature) at each pixel even if the identical voltage or current is supplied to each pixel. Therefore, to minimize the deviation of luminance, chromaticity coordinates and color temperature, the present invention stores a specific compensation value in the memory using the image measuring system described above.

Figure 3A:
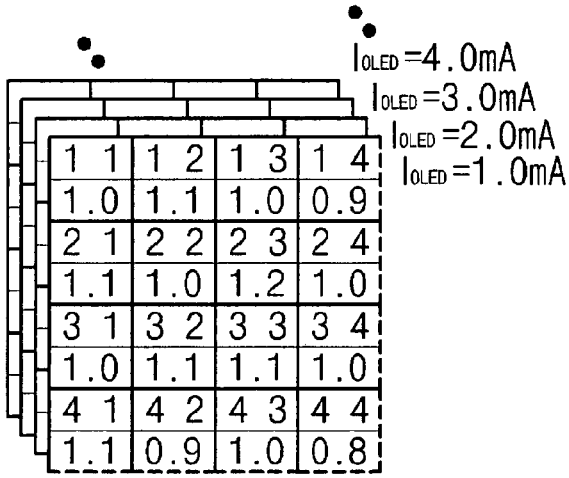
FIGS. 3*a* to 3*c* are views of one embodiment of the look up table at each pixel stored in a memory of an organic light emitting display.
Figure 3B:
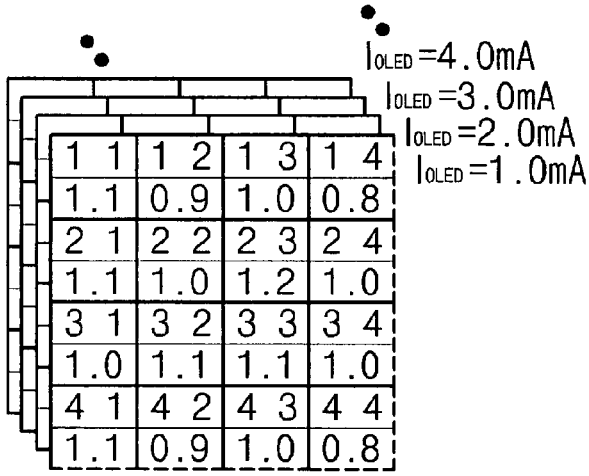
Figure 3C:
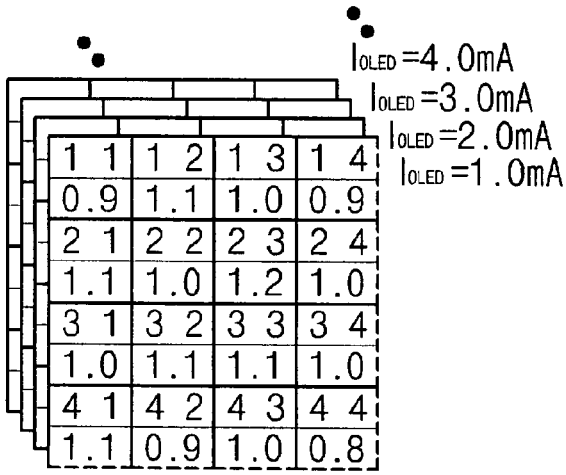

FIGS. 3*a* to 3*c* are views of one embodiment of the look up table at each pixel stored in the memory of the organic light emitting display.

As illustrated in FIG. 3*a*, the organic light emitting display of an embodiment of the present invention stores the luminance compensation value corresponding to every pixel composed of rows and columns in the form of a look up table. For example, if the reference organic light emitting diode current of the respective pixel is 1 mA, then 1.0 of the luminance compensation value is stored in row 1 and column 1, 1.1 is stored in row 1 and column 2, 1.0 is stored in row 1 and column 3, and 0.9 is stored in row 1 and column 4 so as to have the identical luminances. The luminance compensation values with respect to every pixel are stored in this manner.

As illustrated in FIG. 3*b*, the organic light emitting display of the present invention stores the chromaticity coordinate compensation values corresponding to every pixel composed of rows and columns in the form of a look up table. For example, if the reference organic light emitting diode current of the respective pixel is 1 mA, 1.1 of the chromaticity coordinate compensation values is stored in row 1 and column 1, 0.9 is stored in row 1 and column 2, 1.0 is stored in row 1 and column 3, and 0.8 is stored in row 1 and column 4 so as to have the identical chromaticity coordinates. The chromaticity coordinate compensation values with respect to every pixel are stored in this manner.

As illustrated in FIG. 3*c*, the organic light emitting display of an embodiment of the present invention stores the color temperature compensation values corresponding to every pixel composed of rows and columns in the form of a look up table. For example, if the reference organic light emitting diode current of the respective pixel is 1 mA, then 1.0 of the color temperature compensation value is stored in row 1 and column 1, 1.1 is stored in row 1 and column 2, 1.0 is stored in row 1 and column 3, and 0.9 is stored in row 1 and column 4 so as to have the identical color temperatures. The color temperature compensation values with respect to every pixel are stored in this manner.

Furthermore, this look up table may be stored in the memories as classified by the organic light emitting diode current ($I_{OLED}$) as well as by the pixel and is calculated respectively. The look up table is just an example, and the present invention is not restricted by the shape and content of the look up table. That is, it may be difficult for users to check the look up table through the typical processing software, since the look up table is compiled into a computer language. The memory may be stored in, for example, a Programmable Read Only Memory (PROM), an Erasable PROM (EPROM), an Electrically Erasable PROM (EEPROM), flash memory or an equivalent thereof. However, the present invention is not restricted to a specific kind of memory thereof.

In conclusion, if the identical image is input to every pixel, then the luminance, chromaticity coordinates and color temperature compensation values are stored in the memory so as to output the identical image as the look up table of FIGS. 3*a* to 3*c*.

Figure 4:
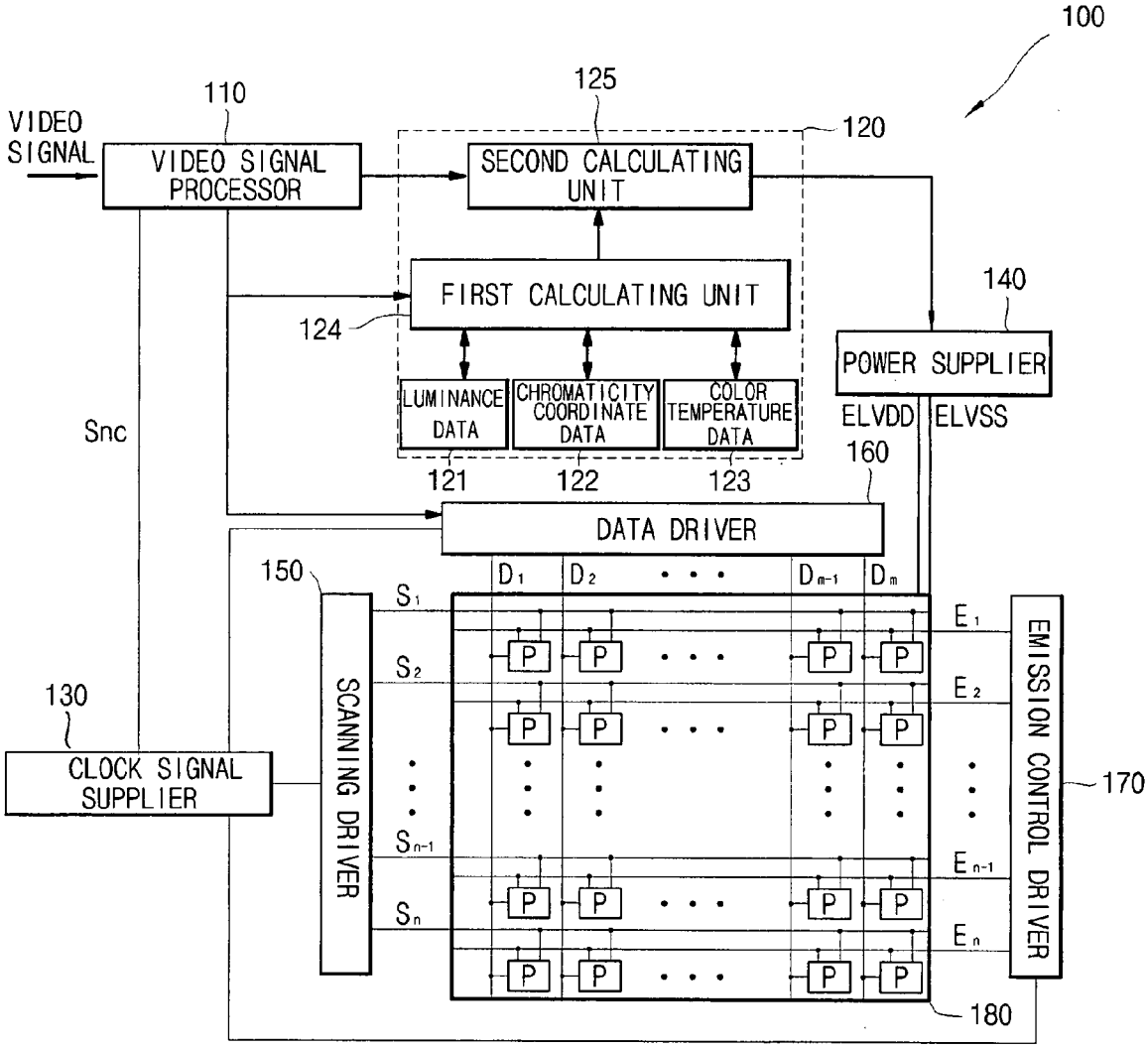
FIG. 4 is a block diagram of an organic light emitting display according to one embodiment of the present invention.

FIG. 4 is a block diagram of an organic light emitting display according to one embodiment of the present invention.

As illustrated in FIG. 4, the organic light emitting display 100 according to one embodiment of the present invention includes a video signal processor 110; a control unit 120; a clock signal supplier 130; a power supplier 140; a scanning driver 150; a data driver 160; an emission control driver 170; and an organic light emitting display panel 180.

The video signal processor 110 samples a video signal from the outside, and divides the signal into a digital video signal of a specific number of bits and a synchronizing signal. The video signal processor 110 outputs the digital video signal of a specific number of bits to the control unit 120, and outputs the synchronizing signal to the clock signal supplier 130.

The control unit 120 is composed of memories 121, 122, and 123, a first calculating unit 124 and a second calculating unit 125.

The luminance compensation values (L'), the chromaticity coordinate compensation values (CC') and the color temperature compensation values (CT') have been previously stored in the memories 121, 122, and 123 in the form of a look up table. The calculating method and the storage of the respective compensation values have been described above, and thus, an explanation thereof has been omitted.

The first calculating unit 124 calculates the first compensation value by using the compensation value corresponding to the digital video signal supplied from the video signal processor 110. That is, the first calculating unit calculates the first compensation value according to the compensation value of the digital video signal allotted to each pixel.

$$\text{first compensation value}=(L'*CC'*CT')$$

L' is the luminance compensation value, CC' is the chromaticity coordinate compensation value and CT' is the color temperature compensation value.

For this end, the digital video signal is supplied from the video signal processor 110 to the first calculating unit 124, and the compensation value of each pixel corresponding to the digital video signal is supplied from the memories 121, 122, and 123 to the first calculating unit 124.

The second calculating unit 125 calculates the second compensation value by using the first compensation value (L'*CC'*CT') and the calibrating constant (a, β or Y) in the video signal at each pixel, and stores it.

The respective pixel image signal has gradation information of each pixel, and the calibrating constant (a, β or Y) may be the calibrating constant in relation to the power supplier 140, the calibrating constant in relation to the data driver 160, and the calibrating constant in relation to the light emitting driver 170. That is, the second compensation value of the second calculating unit 125 is supplied to the power supplier 140 and then multiplies a first compensation value by the calibrating constant in relation to the power supplier 140, the second compensation value of the second calculating unit 125 is supplied to the data driver 160 and then multiplies a first compensation value by the calibrating constant in relation to the data driver 160, and the second compensation value of the second calculating unit 125 is supplied to the light emitting driver 170 and then multiplies a first compensation value by the calibrating constant in relation to the light emitting driver 170.

These are summarized as follows:

When the second compensation value is used to adjust the power supply voltage:

$$ELVDD'=IM*\text{first compensation value}*a$$

wherein, ELVDD' is the compensated power supply voltage, IM is the video signal, and a is the calibrating constant for converting IM* first compensation value into the power supply voltage.

When the second compensation value is used to adjust the data voltage:

$$V\text{data}'=IM*\text{first compensation value}*\beta$$

wherein, Vdata' is the compensated data voltage, IM is the video signal, β is the calibrating constant for converting IM*first compensation value into the data voltage.

When the second compensation value is used to adjust the light emitting time:

$$Em'=IM*\text{first compensation value}*Y$$

wherein, Em' is the compensated light emitting time, IM is the video signal, Y is the calibrating constant for converting IM*first compensation value into the light emitting time.

The operator is defined as multiplication (*). However, the operator may be addition, subtraction, division or the combination thereof, and the operation property of the operator is not restricted thereto.

Therefore, the present invention provides the second compensation value by the second calculating unit 125 of the control unit 120 to one of the power supplier 140, the data driver 160 and the light emitting driver 170.

The clock signal supplier 130 provides the reference clock signal to the scanning driver 150, the data driver 160 and the light emitting driver 170 using the synchronizing signal from the video signal processor 110.

The power supplier 140 provides each pixel of the organic light emitting panel 180 with ELVDD voltage and ELVSS voltage. It is possible to set the value of ELVDD to be higher than that of ELVSS.

The scanning driver 150 provides the scanning signal to the organic light emitting panel in sequence via scanning lines (S1, . . . ,Sn). That is, the scanning driver 150 supplies the scanning signal to the scanning lines (S1, . . . ,Sn) using the clock signal from the clock signal supplier 130.

The data driver 160 provides the data signal to the organic light emitting panel via data lines (D1, . . . ,Dm). That is, the data driver 160 shifts the video signal supplied from the video signal processor 110 by sampling the video signal in sequence, and holds the data line of the first horizontal line.

After that, the data driver 160 latches the video data of the first horizontal line, generates a data signal corresponding to the gradation value of the respective video data and provides the data signal to the data lines at a specific timing.

The emission control driver 170 provides the data signal to the organic light emitting panel in sequence via light emitting lines (E1, . . . ,En). That is, the emission control driver 170 controls the luminance of the organic light emitting panel by controlling the time that the current flows to the organic light emitting diodes. An organic light emitting diode is provided in each R,G,B, and thus, the chromaticity coordinate and color temperature also can be controlled by the control of the light emitting time.

The organic light emitting display panel 180 includes a plurality of scanning lines (S1, . . . , Sn) and light emitting lines (E1, . . . ,En) arranged in the column direction, a plurality of data lines (D1, . . . ,Dm) arranged in the row direction, and a pixel defined by the scanning lines (S1, . . . ,Sn), the light emitting lines (E1, . . . ,En) and the data lines (D1, . . . ,Dm).

A pixel is formed in the pixel region defined by two neighboring scanning lines (or light emitting lines) and two neighboring data lines. As described above, the scanning signal is supplied from the scanning driver 150 to the scanning lines (S1, . . . ,Sn), and the data signal is supplied from the data driver 160 to the data lines (D1, . . . ,Dm), and the light emitting controlling signal is supplied from the emission control driver 170 to the light emitting lines (E1, . . . ,En).

As illustrated in FIG. 4, the power supplier 140, the scanning driver 150, the data driver 160, the emission control driver 170 and the organic light emitting display panel 180 may be formed on one substrate. In particular, the power supplier 140 and drivers 150, 160, and 170 may be formed in an integrated circuit on one substrate. Furthermore, the power supplier 140 and drivers 150, 160, and 170 may be formed on the identical substrate on which the scanning lines (S1, . . . ,Sn), the data lines (D1, . . . ,Dm), the light emitting lines (E1, . . . ,En) and the transistor of the pixel circuit (not shown in the drawings) are formed. The power supplier 140 and drivers 150, 160, and 170 may be formed on another substrate (not shown in the drawings), and the one substrate and the another substrate may be coupled to each other. Furthermore, the power supplier 140 and drivers 150, 160, and 170 may be formed on a Tape Carrier Package (TCP), a Flexible Printed Circuit (FPC), a Tape Automatic Bonding (TAB), a Chip On Glass (COG) or an equivalent thereof, and the shape and location of the power supplier and drivers are not restricted thereto.

Figure 5A:
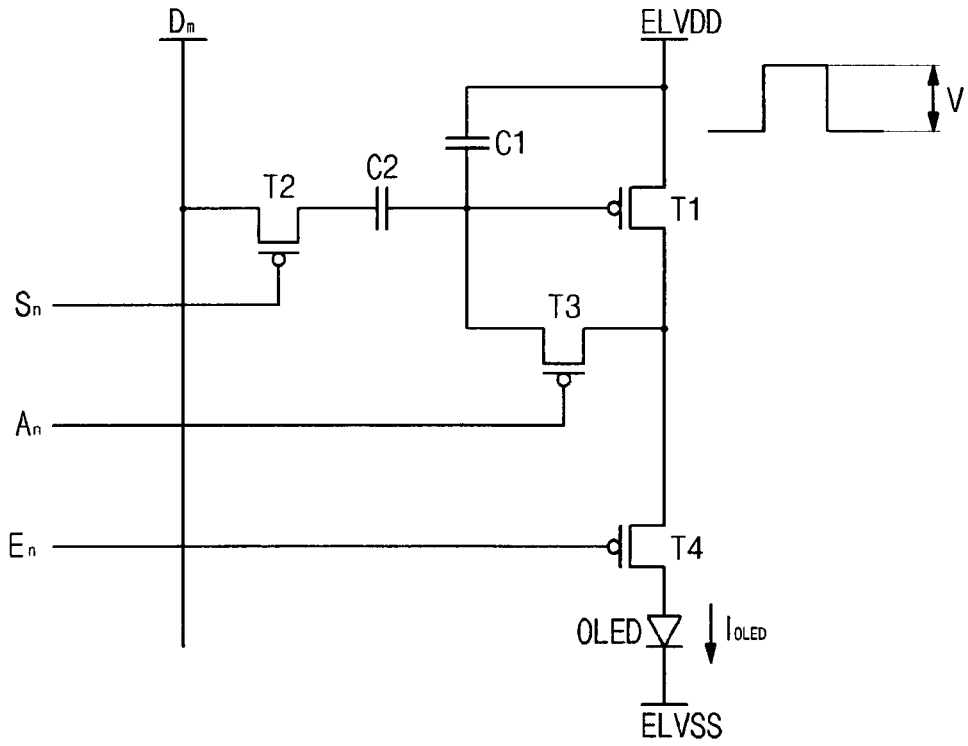
FIG. 5*a* is a circuit diagram of one embodiment of the pixel circuit formed in the panel of FIG. 4
Figure 5B:
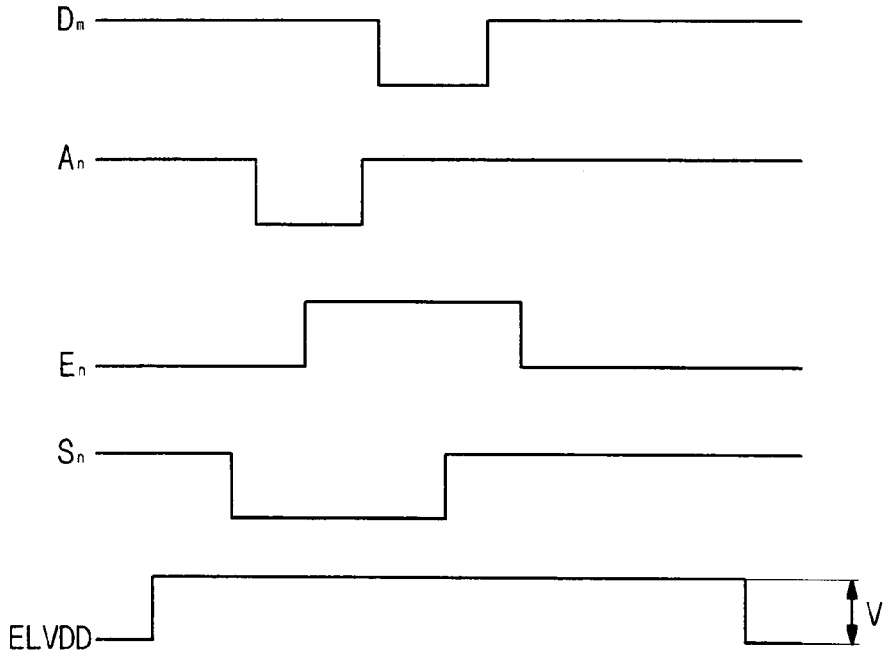
FIG. 5*b* is a timing diagram thereof.

FIG. 5*a* is a circuit diagram of one embodiment of the pixel circuit of the panel of FIG. 4 and FIG. 5*b* is a timing diagram thereof.

As illustrated in FIG. 5*a*, the pixel circuit includes a scanning line (Sn) supplying the scanning signal; a data line (Dm) supplying the data signal; an auto zero line (An) supplying the auto zero signal; a light emitting line (En) supplying the light emitting signal; a first power supply voltage line (ELVDD) supplying the first power supply voltage; a second power supply voltage line (ELVSS) supplying the second power supply voltage; first to fourth transistors (T1, T2, T3, and T4); first and second storage capacitors (C1 and C2) and an Organic Light Emitting Diode (OLED).

The first power supply voltage line (ELVDD) and the second power supply voltage line (ELVSS) are coupled to the power supplier 140, the scanning line (Sn) is coupled to the scanning driver 150, the data line (Dm) is coupled to the data driver 160, and the light emitting line (En) is coupled to the light emitting driver 170. The auto zero line (An) is coupled either to the light emitting driver 170 or to a separate driver.

In this pixel circuit, if an auto zero signal of a low level is supplied from the auto zero line (An) to the control electrode of the third transistor (T3), then the third transistor (T3) is turned on. After that, if a light emitting signal of a high level is supplied from the light emitting line (En) to the control electrode of the fourth transistor (T4), then the fourth transistor (T4) is turned off. In that case, the first transistor (T1) is connected in a diode configuration, and the threshold voltage of the first transistor (T1) is stored in the first storage capacitor (C1). If the auto zero signal becomes a high level and the corresponding data voltage is supplied from the data line (Dm) to the gradation to be displayed, then the data voltage with the compensated threshold voltage is supplied to the control electrode of the first transistor (T1) by the coupling ratio of the first storage capacitor (C1) and the second storage capacitor (C2). If the light emitting signal becomes a low level, then the current from the first power supply voltage line (ELVDD) flows into the OLED through the first transistor (T1) controlling the current by means of the data voltage, and thus the light emitting is accomplished.

The control unit 120 of FIG. 4 supplies the second compensation value to the power supplier 140. The second calculating unit 125 multiplies the first compensation value (L'*CC'*CT') by a calibrating constant (a) in relation to the video signal (IM) and the power supplier 140 and gets the second compensation value (ELVDD'=IM*first compensation value*a), and supplies the second compensation value to the power supplier 140.

Therefore, the voltage (ELVDD or ELVSS) supplied to each pixel is compensated so that an identical image is output at each pixel when the identical video signal is input. For example, as illustrated in FIGS. 5*a* and 5*b*, it is possible to control the current (LED) flowing in the OLED by changing the voltage of the first power supply voltage (ELVDD), and thus the luminance, chromaticity coordinates and color temperature at each pixel is be compensated. Accordingly, the identical image in relation to the identical input image is output by compensating the power supply voltage supplied to each pixel, even if the electrical characteristics, TFT characteristics and organic light emitting diode characteristics are different.

Figure 6:
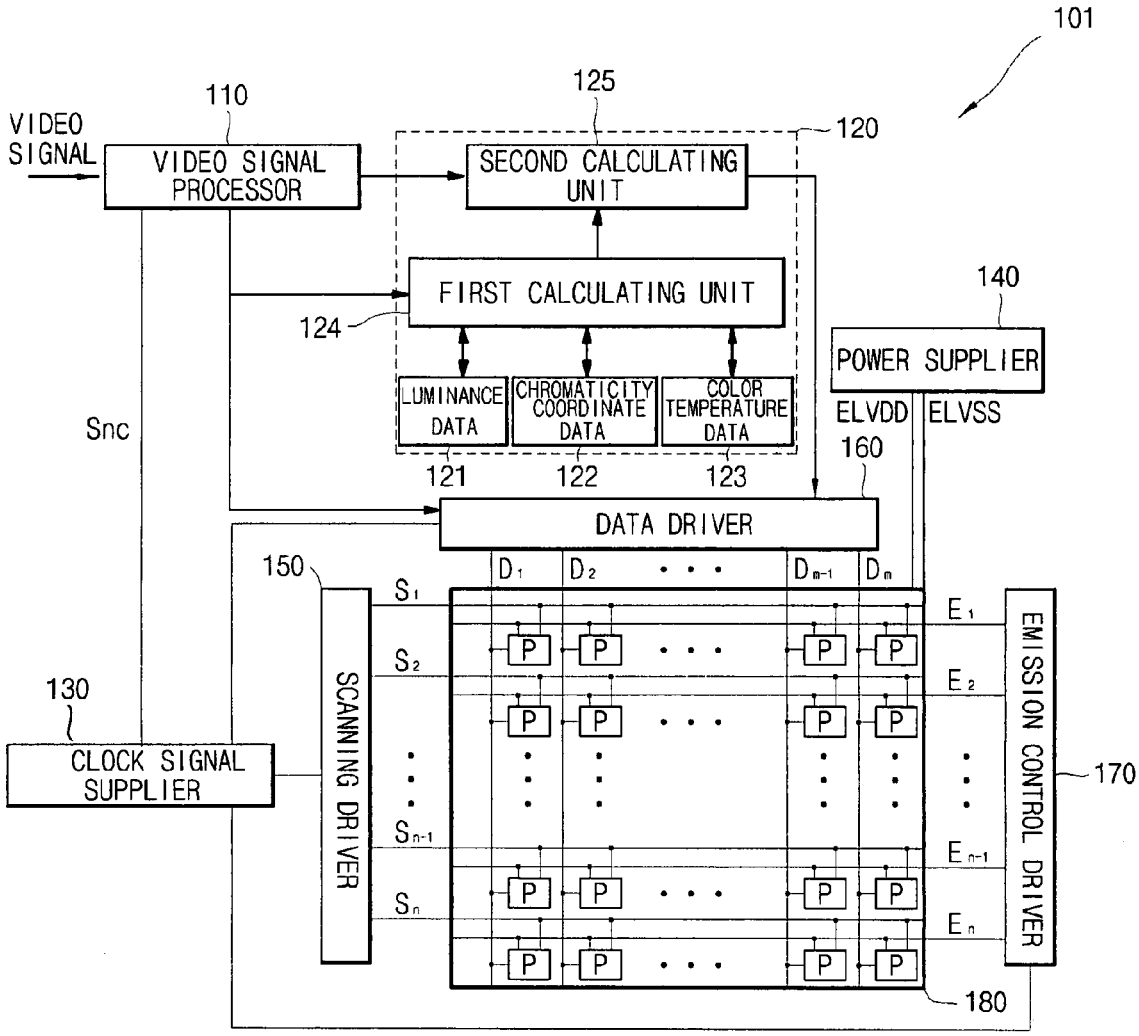
FIG. 6 is a block diagram of an organic light emitting display according to another embodiment of the present invention.

FIG. 6 is a block diagram of an organic light emitting display 101 according to another embodiment of the present invention.

As illustrated in FIG. 6, the organic light emitting display 101 according to another embodiment of the present invention has almost the identical structure as the above described organic light emitting display 100. However, the second compensation value of the control unit 120 is supplied to the data driver 160 instead of to the power supplier 140. That is, the identical image in relation to the identical input image is output by supplying the second compensation value (Vdata') to the data driver 160 instead of the power supplier 140.

$$V\text{data}'=IM*\text{first compensation value}*\beta$$

wherein, Vdata' is the second compensation value, IM is the video signal, and B is the calibrating constant for converting it into the data voltage.

Figure 7A:
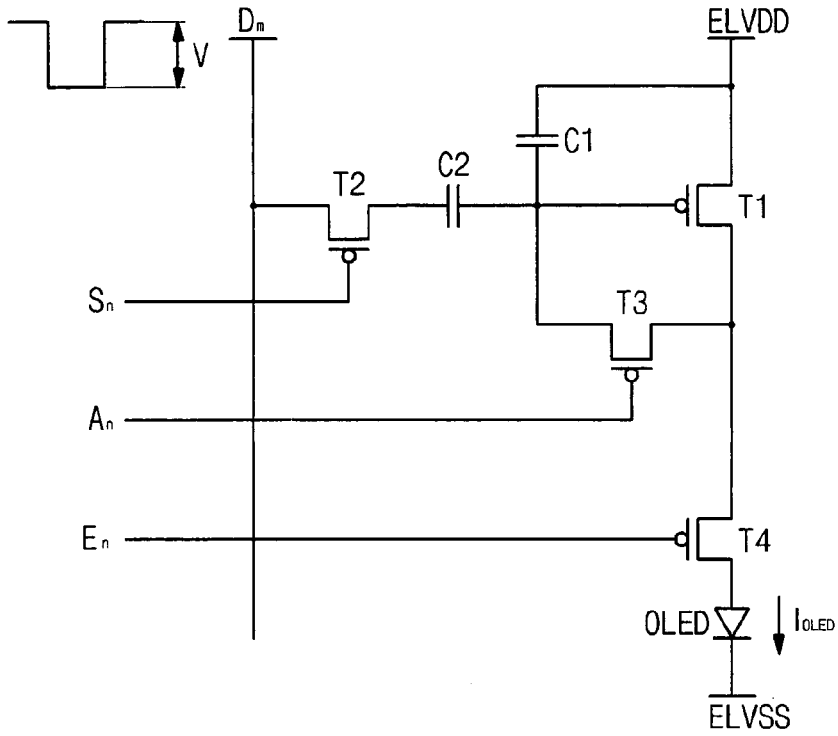
FIG. 7*a* is a circuit diagram of one embodiment of the pixel circuit formed in the panel of FIG. 6
Figure 7B:
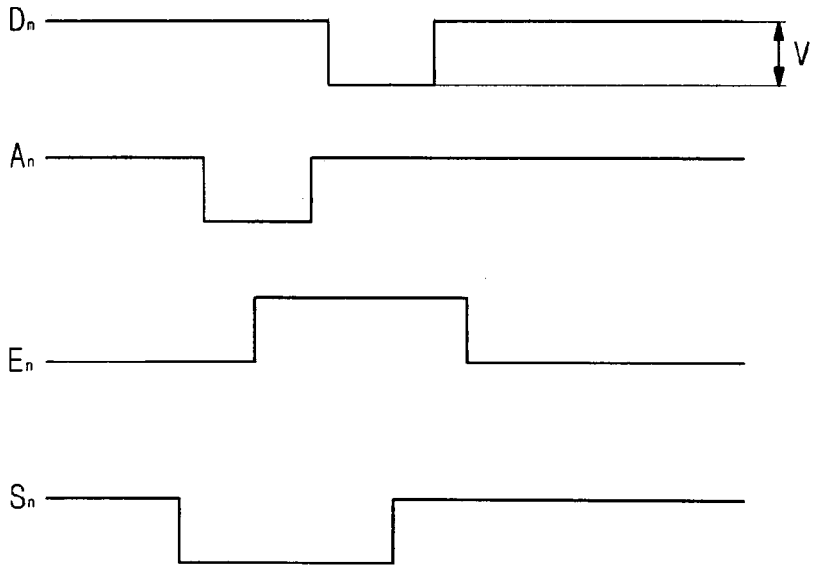
FIG. 7*b* is a timing diagram thereof.

FIG. 7*a* is a circuit diagram of one embodiment of the pixel circuit of FIG. 6 and FIG. 7*b* is a timing diagram thereof.

As illustrated in FIG. 7*a*, the present invention controls the current ($I_{OLED}$) flowing in the OLED by changing the level (V) of the data voltage (V) through the data line (Dm), and thus, the luminance, chromaticity coordinates and color temperature at each pixel is compensated. Therefore, the identical image in relation to the identical input image is output by compensating the data voltage (V) supplied to each pixel, even if the electrical characteristics, TFT characteristics and organic light emitting diode characteristics are different.

Figure 8:
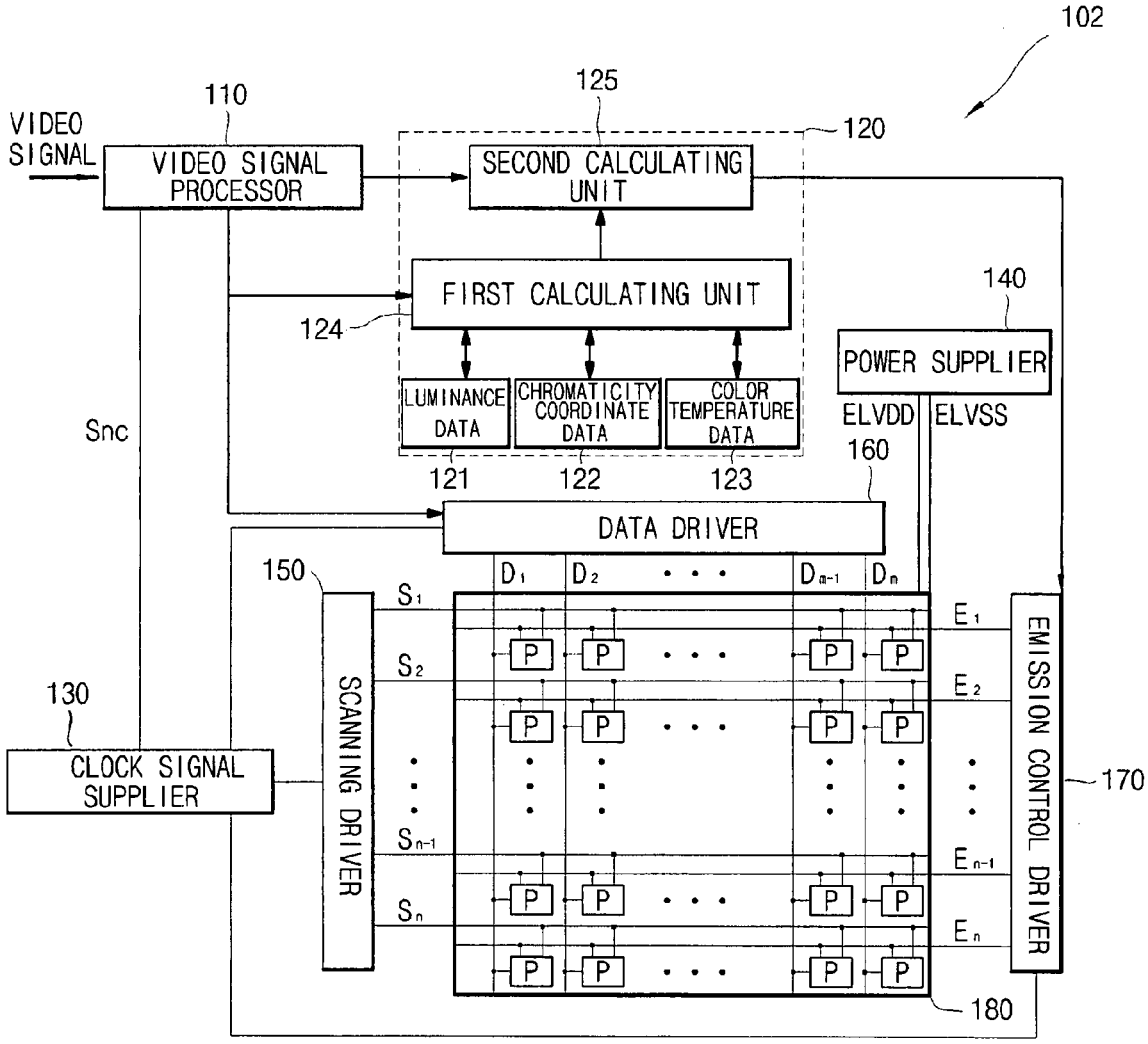
FIG. 8 is a block diagram of an organic light emitting display according to another embodiment of the present invention.

FIG. 8 is a block diagram of an organic light emitting display 102 according to another embodiment of the present invention.

As illustrated in FIG. 8, the organic light emitting display 102 according to another embodiment of the present invention has almost the identical structure as the above described organic light emitting display 100. However, the second compensation value of the control unit 120 is supplied to the light emitting driver 170 instead of to the data driver 160. That is, the identical image in relation to the identical input image is output by supplying the second compensation value (Em') determined by the following formula to the light emitting driver 170 instead of the data driver 160.

$$Em'=IM^{*}\text{first compensation}^{*}Y$$

wherein, Em' is the second compensation value, IM is the video signal, T is the calibrating constant for converting it into the light emitting time.

Figure 9A:
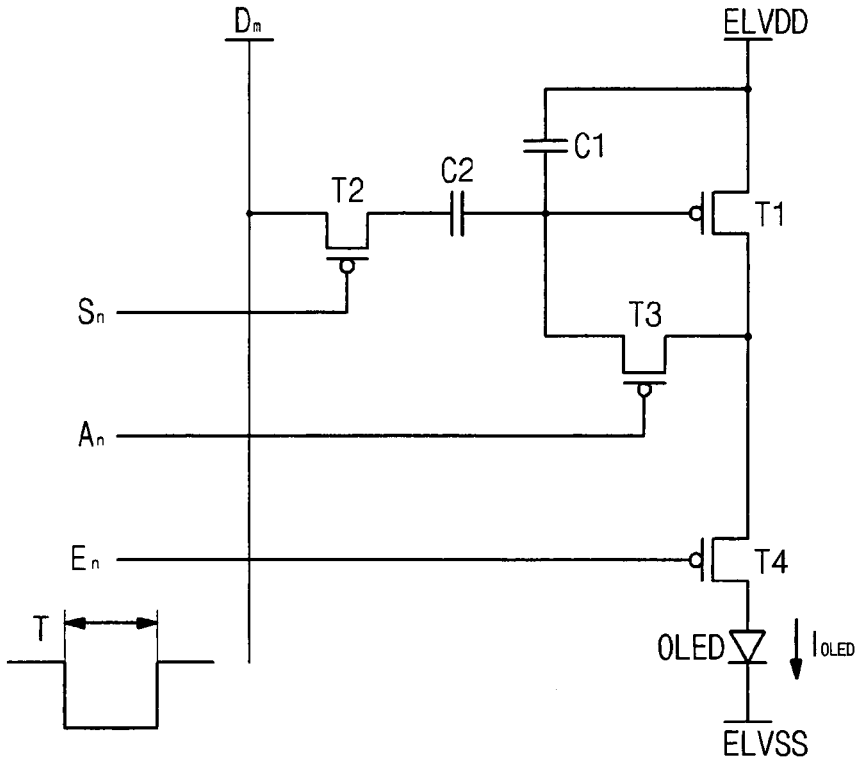
FIG. 9*a* is a circuit diagram of one embodiment of the pixel circuit formed in the panel of FIG. 8
Figure 9B:
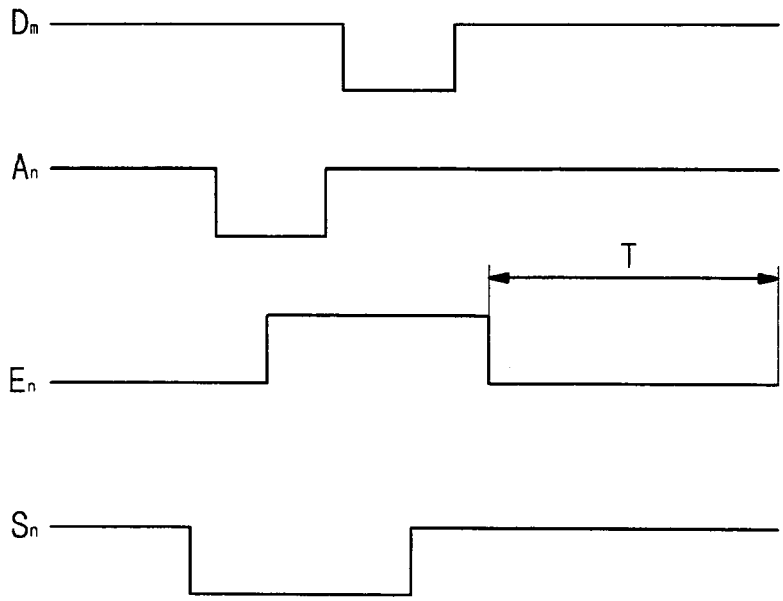
FIG. 9*b* is a timing diagram thereof.

FIG. 9*a* is a circuit diagram of one embodiment of the pixel circuit of the display panel 180 of FIG. 8 and FIG. 9*b* is a timing diagram thereof.

As illustrated in FIG. 9*a*, the present invention controls the light emitting time of the OLED by changing the length of the light emitting time (T) through the emission control line (En), and thus the luminance, chromaticity coordinates and color temperature at each pixel are compensated. Therefore, the identical image in relation to the identical input image is output by compensating the light emitting time supplied to each pixel, even if the electrical characteristics, TFT characteristics and organic light emitting diode characteristics are different.

Figure 10:
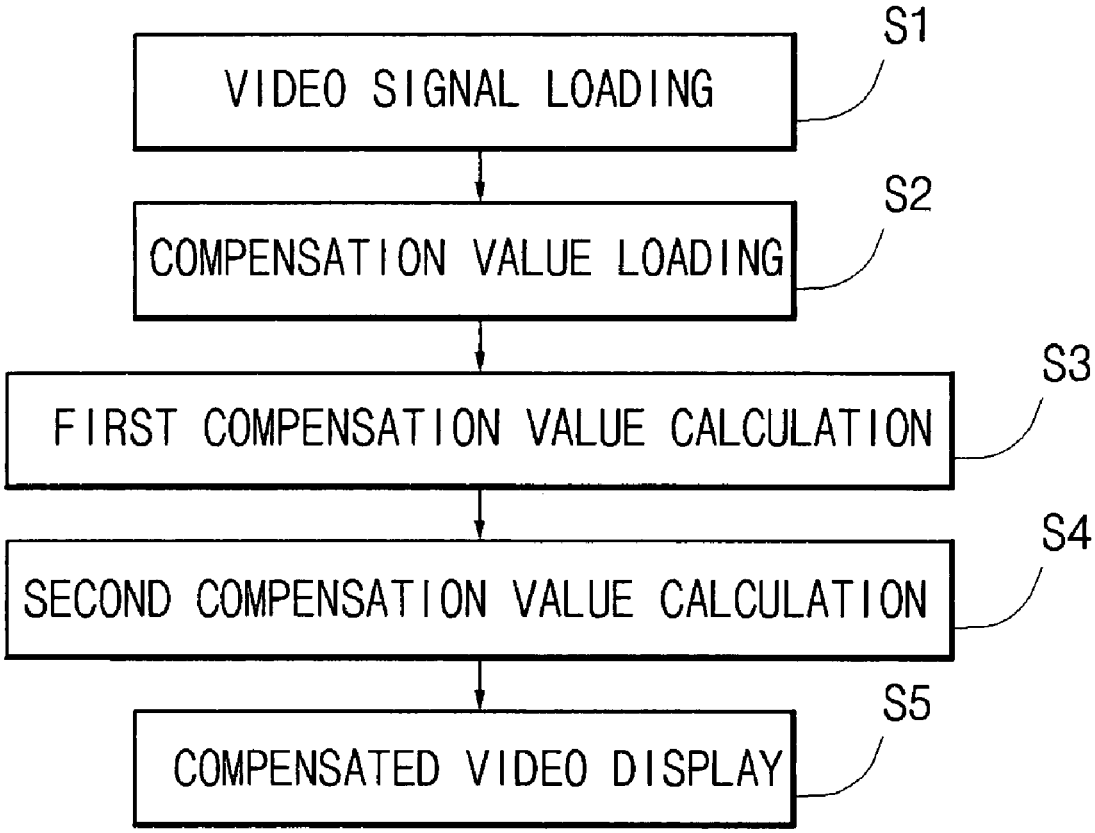
FIG. 10 is a flowchart of an image compensation method according to an embodiment of the present invention.

FIG. 10 is a flowchart of the image compensation method according to an embodiment of the present invention.

As illustrated in FIG. 10, an image compensation method of the organic light emitting display according to the present invention includes a video signal loading step (S1); a compensation value loading step (S2); a first compensation value calculating step (S3); a second compensation value calculating step (S4); and a compensated video displaying step (S5).

In the video signal loading step (S1), the video signal is loaded from the video signal processor 110 in the organic light emitting display.

In compensation value loading step (S2), the luminance compensation value (L'), the chromaticity coordinate compensation values (CC') and the color temperature compensation value (CT') corresponding to the video signal at each pixel are loaded. Of course, the compensation values have been stored in the memories (121, 122, and 123) in advance.

In the first compensation value calculating step (S3), the first compensation value is calculated by calculating the luminance compensation value, the chromaticity coordinate compensation value and the color temperature compensation value by means of the operator.

$$\text{first compensation value}=[L'^{*}CC'^{*}CT']$$

In the second compensation value calculating step (S4), the second compensation value is calculated and output by calculating the video signal with the first compensation value and the calibrating constant.

When the second compensation value is used to adjust the power supply voltage $$ELVDD'=IM^{*}\text{first compensation value}^{*}a$$

wherein, ELVDD' is the compensated power supply voltage, IM is the video signal, and a is the calibrating constant for converting IM* first compensation value into the power supply voltage.

When the second compensation value is used to adjust the data voltage $$V\text{data}'=IM^{*}\text{first compensation value}^{*}\beta$$

wherein, Vdata' is the compensated data voltage, IM is the video signal, β is the calibrating constant for converting IM*first compensation value into the data voltage.

When the second compensation value is used to adjust the light emitting time $$Em'=IM^{*}\text{first compensation value}^{*}Y$$

wherein, Em' is the compensated light emitting time (the second compensation value), IM is the video signal, Y is the calibrating constant for converting IM*first compensation value into the light emitting time.

In the compensated video displaying step (S5), the second compensation value is supplied to the organic light emitting display panel 180 so that the identical out image in relation to the identical input image is displayed.

The second compensation value may be supplied to the power supplier 140, the data driver 160 and the emission control driver 170.

For example, if the second compensation value (ELVDD') is supplied to the supplier 140, then the identical out image in relation to the identical input image is displayed because the power supply voltage supplied to the organic light emitting display panel 180 is compensated to a certain level at each pixel.

If the second compensation value (Vdata') is supplied to the data driver 160, then the identical out image in relation to the identical input image is displayed because the data voltage supplied to the organic light emitting display panel 180 is compensated to a certain level at each pixel.

If the second compensation value (Em') is supplied to the emission control driver 170, then the identical out image in relation to the identical input image is displayed because the light emitting time supplied to the organic light emitting display panel 180 is compensated to a certain time at each pixel.

Therefore, the present invention improves the LRU by displaying the identical luminance, chromaticity coordinates and color temperature using the luminance, chromaticity coordinates and color temperature compensation values which have previously been stored in the memories.

As described above, the organic light emitting display and image compensation method according to the present invention previously stores the luminance compensation values, the chromaticity coordinate compensation values and the color temperature compensation values in the memories in the form of a look up table by measuring the luminance, the chromaticity coordinate a and the color temperature after the organic light emitting display panel is fabricated so that the identical out image in relation to the identical input image is displayed.

In addition to, the organic light emitting display and image compensation method according to the present invention improves the Long Range Uniformity (LRU) as well as the Short Range Uniformity (SRU) by compensating at least one of the power supply voltage, the data voltage and the light emitting time using the compensation values which have been previously stored in the memories.

The explained hitherto is to be considered in all respects as illustrative and not restrictive so as to execute the organic light emitting display and image compensation method according to the present invention, the present invention is not restricted to illustrative embodiments, it should be understood that the invention is not limited thereto. Those having ordinary skill in the art will recognize additional compensations, applications, and embodiments without departing from the scope of the present invention as defined by the following claims.

What is claimed is:

1. An organic light emitting display comprising:

a video signal processor generating digital video signals;

a control unit coupled to the video signal processor, the control unit obtaining a compensation value as a function of the digital video signals supplied to the control unit from the video signal processor;

an organic light emitting display panel coupled to the control unit, the organic light emitting display panel displaying a video compensated by the compensation value obtained from the control unit, the control unit comprising a memory to store a luminance compensation value, a chromaticity coordinate compensation value and a color temperature compensation value for the organic light emitting display panel, the compensation value including a first compensation value being obtained by calculations involving the luminance compensation value, the chromaticity coordinate compensation value and the color temperature compensation value;

a power supplier to supply a power supply voltage to the organic light emitting display panel;

a scanning driver coupled to the video signal processor and supplying scanning drive signals to the organic light emitting display panel;

a data driver coupled to the video signal processor and supplying a data voltage to the organic light emitting display panel; and an emission control driver coupled to the video signal processor and supplying a light emitting time to the organic light emitting display panel.

2. The organic light emitting display as claimed in claim 1, wherein the control unit comprises:

a first calculating unit to calculate the first compensation value for the digital video signals;

a second calculating unit to calculate a second compensation value for the digital video signals, the second compensation value being obtained by calculations involving the first compensation value and a calibrating constant.

3. The organic light emitting display as claimed in claim 2, wherein the calibrating constant is a value corresponding to at least one of the power supply voltage, the data voltage and the light emitting time.

4. The organic light emitting display as claimed in claim 2, wherein the memory stores a look-up table including the luminance compensation value, the chromaticity coordinate compensation value and the color temperature compensation value.

5. The organic light emitting display as claimed in claim 2, wherein the second calculating unit supplies the second compensation value to the power supplier.

6. The organic light emitting display as claimed in claim 5, wherein the power supplier supplies the organic light emitting display panel with a compensated power supply voltage according to the second compensation value.

7. The organic light emitting display as claimed in claim 2, wherein the second calculating unit supplies the second compensation value to the data driver.

8. The organic light emitting display as claimed in claim 7, wherein the data driver supplies the organic light emitting display panel with a compensated data voltage according to the second compensation value.

9. The organic light emitting display as claimed in claim 2, wherein the second calculating unit supplies the second compensation value to the emission control driver.

10. The organic light emitting display as claimed in claim 9, wherein the emission control driver supplies the organic light emitting display panel with a compensated light emitting time according to the second compensation value.

11. The organic light emitting display as claimed in claim 1, further comprising a clock signal supplier coupled to the video signal processor, the video signal processor supplying a synchronizing signal to the clock signal supplier.

12. The organic light emitting display as claimed in claim 11, wherein the clock signal supplier supplies the synchronizing signal and a clock signal to the scanning driver, the data driver and the emission control driver.

13. An image compensation method of an organic light emitting display, the method comprising:

loading digital video signals;

loading a compensation value including a luminance compensation value, a chromaticity coordinate compensation value and a color temperature compensation value for each pixel;

calculating a first compensation value by calculations involving the luminance compensation value, the chromaticity coordinate compensation value and the color temperature compensation value;

calculating a second compensation value by calculations involving the first compensation value and a calibrating constant; and displaying a compensated video compensated by the second compensation value on the organic light emitting display panel.

14. The image compensation method as claimed in claim 13, wherein the calibrating constant is a value corresponding to at least one of a power supply voltage, a data voltage and a light emitting time of the organic light emitting display panel.

15. The image compensation method as claimed in claim 13, wherein the second compensation value is supplied to one of a power supplier, a data driver and an emission control driver of the organic light emitting display panel.

16. The image compensation method as claimed in claim 13, wherein the calibrating constant is to compensate a power supply voltage of the organic light emitting display panel, and the second compensation value is supplied to a power supplier of the organic light emitting display panel.

17. The image compensation method as claimed in claim 13, wherein the calibrating constant is to compensate a data voltage of the organic light emitting display panel, and the second compensation value is supplied to a data driver of the organic light emitting display panel.

18. The image compensation method as claimed in claim 13, wherein the calibrating constant is to compensate a light emitting time of the organic light emitting display panel, and the second compensation value is supplied to an emission control driver of the organic light emitting display panel.

19. The image compensation method as claimed in claim 13, wherein the organic light emitting display comprises:

a memory to store the luminance compensation value, the chromaticity coordinate compensation value and the color temperature compensation value for the organic light emitting display panel;

a first calculating unit to calculate the first compensation value for the digital video signals, the first compensation value being obtained by calculations involving the luminance compensation value, the chromaticity coordinate compensation value and the color temperature compensation value;

a second calculating unit to calculate the second compensation value for the digital video signals, the second compensation value being obtained by calculations involving the first compensation value and a calibrating constant.

* * * * *